US005125245A

United States Patent [19]

Kuwabara

[11] Patent Number: 5,125,245

[45] Date of Patent: Jun. 30, 1992

[54] KNITTING YARN GUIDE

[75] Inventor: Junichi Kuwabara, Amagasaki, Japan

[73] Assignee: Clover Mfg. Co., Ltd., Osaka, Japan

[21] Appl. No.: 442,220

[22] Filed: Nov. 28, 1989

[51] Int. Cl.[5] ..... D04B 39/00; E05D 1/00

[52] U.S. Cl. ..... 66/1 A; 16/225

[58] Field of Search ..... 66/1 A, 125, 225; D3/18, 20, 21, 22, 23, 26; D11/12, 28, 184, 215, 220; 16/225, DIG. 13

[56] References Cited

U.S. PATENT DOCUMENTS

| | | | |
|---|---|---|---|
| 2,524,157 | 10/1950 | Beirer | 66/125 R |
| 3,043,354 | 7/1962 | Fitzgerald | 16/225 X |
| 3,793,612 | 2/1974 | Driscoll | 16/225 X |
| 4,261,486 | 4/1981 | Bush et al. | 16/225 X |
| 4,713,947 | 12/1987 | Collins et al. | 66/1 A |

FOREIGN PATENT DOCUMENTS

| | | | |
|---|---|---|---|
| 406127 | 4/1968 | Australia | 16/225 |
| 1404143 | 5/1965 | France | 16/225 |
| 61-33022 | 9/1986 | Japan . | |
| 62-60278 | 4/1987 | Japan . | |

OTHER PUBLICATIONS

How to Design an "Integral" hinge-Modern Plastics Oct. 1963, pp. 166-168.

*Primary Examiner*—Werner H. Schroeder
*Assistant Examiner*—John J. Calvert
*Attorney, Agent, or Firm*—William H. Eilberg

[57] ABSTRACT

A knitting yarn guide according to the invention comprises a mounting ring fittable on a knitter's finger. The mounting ring has an elongated flat support surface extending axially of the ring and formed with integral yarn guide pins which are spaced from each other axially of the ring. A hinge arm 3 is connected to the ring at one end of the support surface by an integral hinge, and has a free end removably engageable with the ring at the other end of the support surface. The arm is pivotable about the hinge from an open position to a yarn guiding position in which the arm cooperates with the support surface to define separate yarn guide passages between the yarn guide pins.

9 Claims, 3 Drawing Sheets

KNITTING YARN GUIDE

BACKGROUND OF THE INVENTION

1. Field of the Invention

This invention relates generally to knitting articles used for facilitating a knitting operation. More particularly, the present invention relates to a knitting yarn guide which is fitted on a knitter's finger for guiding one or more yarns to stabilize the yarn feeding position as required for providing an efficient knitting operation, especially for facilitating pattern formation using two or more yarns of different colors.

2. Description of the Prior Art

In knitting a work such as sweater, a yarn or yarns paid out from a yarn source or sources are usually guided over a knitter's forefinger (of the left hand generally) to form stitches by using a pair of knitting needles. Obviously, the yarn must be supplied with a specific orientation relative to the knitting needle in order to facilitate yarn pick-up by the needle tip for forming each stitch. However, when guided manually by the knitter's forefinger, the yarn may displace laterally on the forefinger due to the stitch forming movement of the needle tip and/or the knitter's hands, thus changing the yarn supplying orientation. Further, the yarn comes in direct sliding contact with the forefinger, so that the forefinger may be injured after a long or repeated knitting operation.

To avoid such a problem, there have been proposed various yarn guides each of which includes a mounting portion fittable on a knitter's forefinger, and a yarn guiding means supported on the mounting portion. Typical examples of such yarn guide is disclosed for example in Japanese Utility Model Application Laid-open No. 62-60278 and Japanese Utility Model Publication No. 61-33022.

More specifically, Japanese Utility Model Application No. 62-60278 discloses a yarn guide which comprises a mounting ring fittable on a knitter's forefinger, a base plate fixed on top of the mounting ring, and yarn guide rings fixed on the base plate for slidably guiding yarns. Each yarn guide ring has a split by which the corresponding yarn is introduced into the guide ring.

This prior art yarn guide is disadvantageous in that it requires many separate parts which must be prepared separately and later assembled together, thereby increasing the cost of the yarn guide. For example, the base plate must be welded to the mounting ring, while the yarn guide rings must be individually welded to the base plate. Further, yarn setting relative to the yarn guide rings is trouble because the yarn must be introduced through the narrow split of the guide ring. An attempt to widen the ring split for facilitating the yarn setting operation will result in an increased possibility that the guided yarn may unexpectedly pass through the widened split to come out of the guide ring during the knitting operation.

Japanese Utility Model Publication No. 61-33022 discloses a yarn guide which comprises a fingerstall, a row of yarn guide pins mounted on the fingerstall as spaced from each other axially of the fingerstall, and an arm pivotally mounted on the fingerstall by means of a pivot shaft. The arm is arranged in a plane containing the upper ends of the respective yarn guide pins, so that the arm is pivotable in that plane from an open position to a yarn guiding position for contact with the upper ends of the guide pins to define yarn guide passages.

The yarn guide of this Japanese publication provides easier yarn setting than the previously described prior art. However, this yarn guide also requires separate parts, such as fingerstall and arm, which must be prepared separately and later assembled. Further, the arm must be riveted to the shaft, which results in a cost increase.

In use, the fingerstall type yarn guide requires the arm to be pivoted exactly to the yarn guiding position because improper positioning of the arm may cause unexpected removal of the guided yarn. Further, since the arm is supported only at the pivot shaft, the arm may be easily pivoted out of the yarn guiding position by contact with an external object. Moreover, the fingerstall provides an awkward feel when manipulating the knitting needle.

SUMMARY OF THE INVENTION

It is, therefore, an object of the present invention to provide a knitting yarn guide which can be manufactured easily at a low cost.

Another object of the present invention to provide a yarn guide which provides ready yarn setting.

A further object of the present invention is to provide a yarn guide which, after the yarn setting, prevents the yarns from unexpectedly coming out of yarn guide passages.

Still another object of the invention is to provide a mold which is suitable for producing the yarn guide.

According to the present invention, there is provided a knitting yarn guide comprising: a resinous mounting ring having a finger insertion opening and providing a support surface, the support surface having a first end and a second end spaced from the first end, the ring being formed with a first engaging portion at the first end; yarn guide projections formed integrally on the support surface between the first and second ends, the projections being spaced from each other; and a hinge arm connected to the mounting ring at the second end by a hinge integral with the arm and the ring, the ar being pivotable about the hinge between an open position away from the support surface and a yarn guiding position opposed to the support surface, the arm having a free end formed with a second engaging portion which is removably engageable with the first engaging portion when the arm assumes the yarn guiding position to define separate yarn guide passages between the yarn guide projections in cooperation with said support surface.

Preferably, the yarn guide projections are in the form of pins upstanding from the support surface which is flat and elongated axially of said ring. The hinge may be advantageously provided by a thin-walled portion.

According to a preferred embodiment of the present invention, the hinge arm is formed with an elongated opening through which the yarn guide projections penetrate when the arm assumes the yarn guiding position. Further, the first engaging portion may be in the form of an engaging projection, whereas the second engaging portion may be in the form of an engaging pawl.

Other objects, features and advantages of the present invention will be fully understood from the following detailed description given with reference to the accompanying drawings.

DETAILED DESCRIPTION

Referring to FIGS. 1 to 4 of the accompanying drawings, there is illustrated a knitting yarn guide which is an integral piece made of a resin such as polypropylene. The yarn guide mainly comprises a mounting ring 1, yarn guide pins 2 projecting upward from the mounting ring, and a hinge arm 3 connected t the mounting ring.

The mounting ring 1 defines a finger insertion opening 1*a*. The ring has, at its top, a flat support surface 1*b* which is elongated axially of the ring. Thus, the support surface is generally rectangular in plan view, as clearly shown in FIG. 3. Preferably, the ring has a split 1*c*, so that the diameter of the finger insertion opening la is variable to adapt to substantially any knitter.

The yarn guide pins 2, which are integral with the mounting ring 1, are arranged on the elongated support surface 1*b* in a row as spaced from each other longitudinally of the support surface. The mounting ring 1 is further formed, at one end of the elongated support surface lb, with an engaging projection 1*d*.

Figure 3:
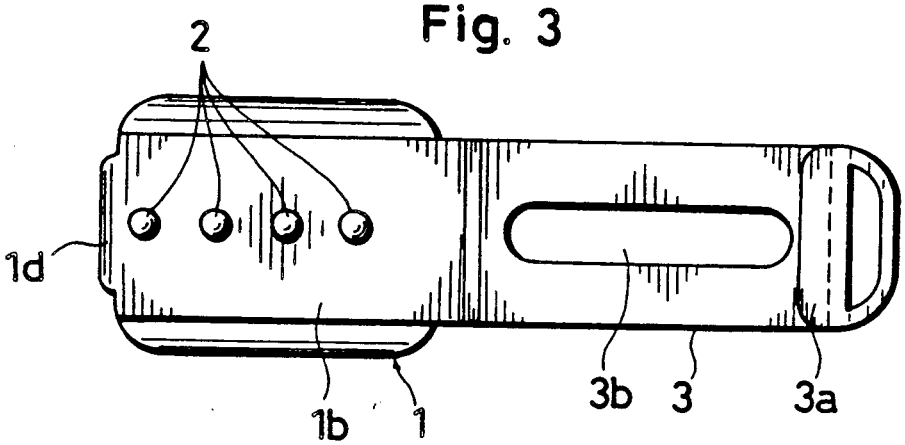
FIG. 3 is a top plan view of the yarn guide.
Figure 4:
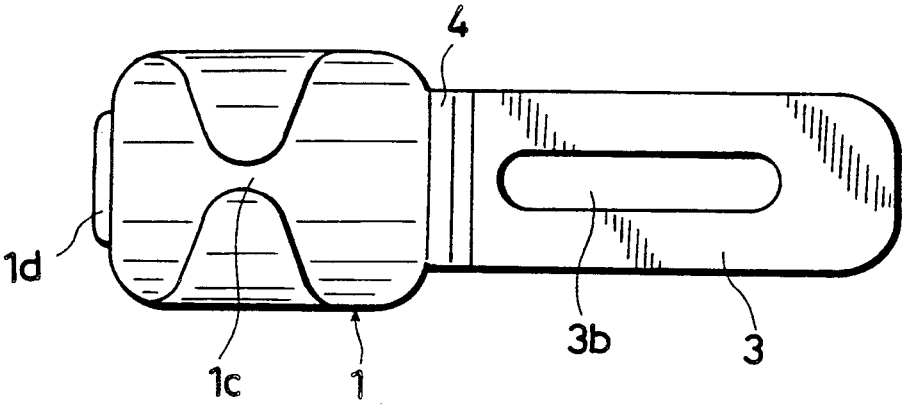
FIG. 4 is a bottom view of the yarn guide.

The hinge arm 3 is generally rectangular in plan view, as shown in FIGS. 3 and 4. The hinge arm is connected to the mounting ring 1 by an integral hinge 4 located at the other end of the elongated support surface lb. Thus, the hinge arm can be pivoted about this hinge between an open position (solid line position in FIG. 1) and a yarn guiding position (broken line position in FIG. 1). The hinge 4 may be most advantageously provided by a thin-walled portion.

Figure 1:
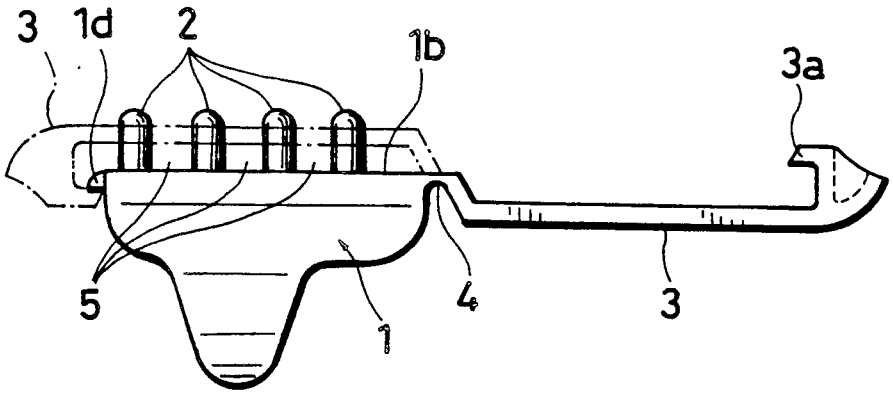
FIG. 1 is a side view showing a knitting yarn guide according to the present invention.
Figure 2:
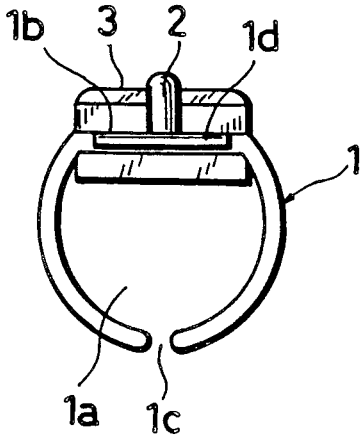
FIG. 2 is a front view of the same yarn guide.

The hinge arm 3 has a free end formed with an engaging pawl 3*a*. Thus, when the arm is pivoted to its yarn guiding position, the engaging pawl 3*a* is engaged with the engaging projection 1*d* to hold the arm in this position. In the yarn guiding position, the arm cooperates with the flat support surface 1*b* of the mounting ring 1 to define yarn guide passages 5 between the yarn guide pins 2, as shown in FIG. 1. Each yarn guide passage 5 is of such a size that it can accept yarns of various thicknesses, thereby expanding the applicability of the yarn guide.

According to the embodiment illustrated in FIGS. 1 to 4, the hinge arm 3 is further formed with a central elongated opening 3*b* which allows penetration of the yarn guide pins 2 when the arm is pivoted to the yarn guiding position. In this way, the yarn guide pins do not hinder the arm from pivoting completely to its yarn guiding position. Alternatively, the yarn guide pins 2 may be rendered lower than illustrated, and the hinge arm may be formed with a groove or recesses (not shown) for receiving the yarn guide pins when the arm is pivoted to the yarn guide position. Further, the yarn guide pins may be made low enough, so that the respective upper ends of the pins come into intimate contact with the hinge arm (non-bored, non-grooved, non-recessed) pivoted to the yarn guiding position.

Figure 5:
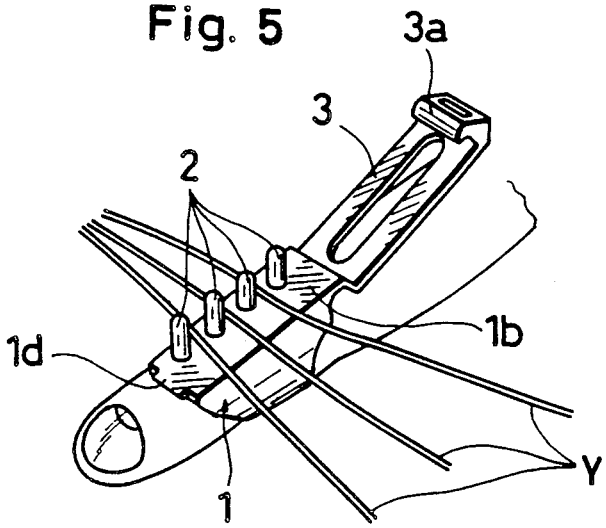
FIG. 5 is a perspective view showing the yarn guide in its state for yarn setting.
Figure 6:
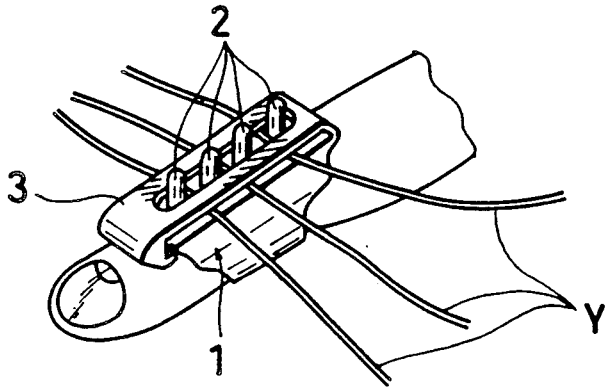
FIG. 6 is a perspective view showing the yarn guide after yarn setting.

In use, the mounting ring 1 is fitted on a finger (usually the forefinger of the left hand) of a knitter with the hinge arm 3 brought to its open position, and knitting yarns Y of different colors paid out from separate yarn sources (not shown) are separately placed between the yarn guide pins 2, as shown in FIG. 5. Then, the hinge arm 3 is simply folded over the support surface 1*b* of the ring, as shown in FIG. 6. As a result, the engaging pawl 3*a* of the hinge arm is automatically comes into engagement with the engaging projection 1*d* of the ring when the arm assumes its complete yarn guiding position.

It is now assumed that a knitted article or work (not shown) is partially formed with the respective yarns Y connected thereto. In the knitting operation, the yarns Y are selectively used to form stitches, thereby enabling various patterns to be incorporated into the knitted article. If required, one or more of the yarns Y may be replaced by differently colored yarns during the knitting operation.

The knitting yarn guide according to the present invention ha the following functions and/or advantages.

(1) The yarn guide passages 5 (FIG. 1 limit the transverse movements of the corresponding yarns Y within the respective passages while allowing free guided movement of the yarns lengthwise thereof. Thus, the yarn pay-out position is substantially fixed to facilitate the knitting operation. Further, the yarns are prevented from entangling with each other during the knitting operation.

(2) The flat support surface 1*b* of the mounting ring 1 slidably supports the respective yarns Y, so that the yarns are prevented from coming in direct sliding contact with the ring mounting finger. In this way, the ring mounting finger can be kept free of any damage even after a long or repeated knitting operation.

(3) The spacing between the yarn guide pins 2 can be set large enough to facilitate placement, from above, of the corresponding yarns. Further, since the integral hinge 4 always provides a constant pivotal path, the hinge arm 3 needs only be pivoted to the yarn guiding position without requiring any positional adjustment. Moreover, the engagement between the engaging projection 1*d* and the engaging pawl 3*a* is achieved automatically when the hinge arm reaches its yarn guiding position. Therefore, setting of the yarns can be conducted very easily and quickly.

(4) Once the hinge arm 3 is pivoted to the yarn guiding position, it is fixed to the mounting ring 1 not only at the integral hinge 4 but also at the free end by engagement between the engaging projection 1*d* and the engaging pawl 3*a*. Thus, the hinge arm is firmly fixed to the mounting ring at two positions to prevent the arm from coming out of the yarn guiding position even when the arm comes into contact with an external object during the knitting operation, whereby the yarns are always prevented from coming out of the yarn guide passages 5.

(5) All portions of the yarn guide are integral with each other, so that the yarn guide can be formed by a single molding operation. Therefore, the yarn guide can be manufactured at a low cost without requiring the provision of separate parts.

Obviously, the yarn guide according to the present invention can be also used to guide only a single yarn to form a single-colored knit. Such a use is often necessary for an unskilled knitter.

Figure 7:
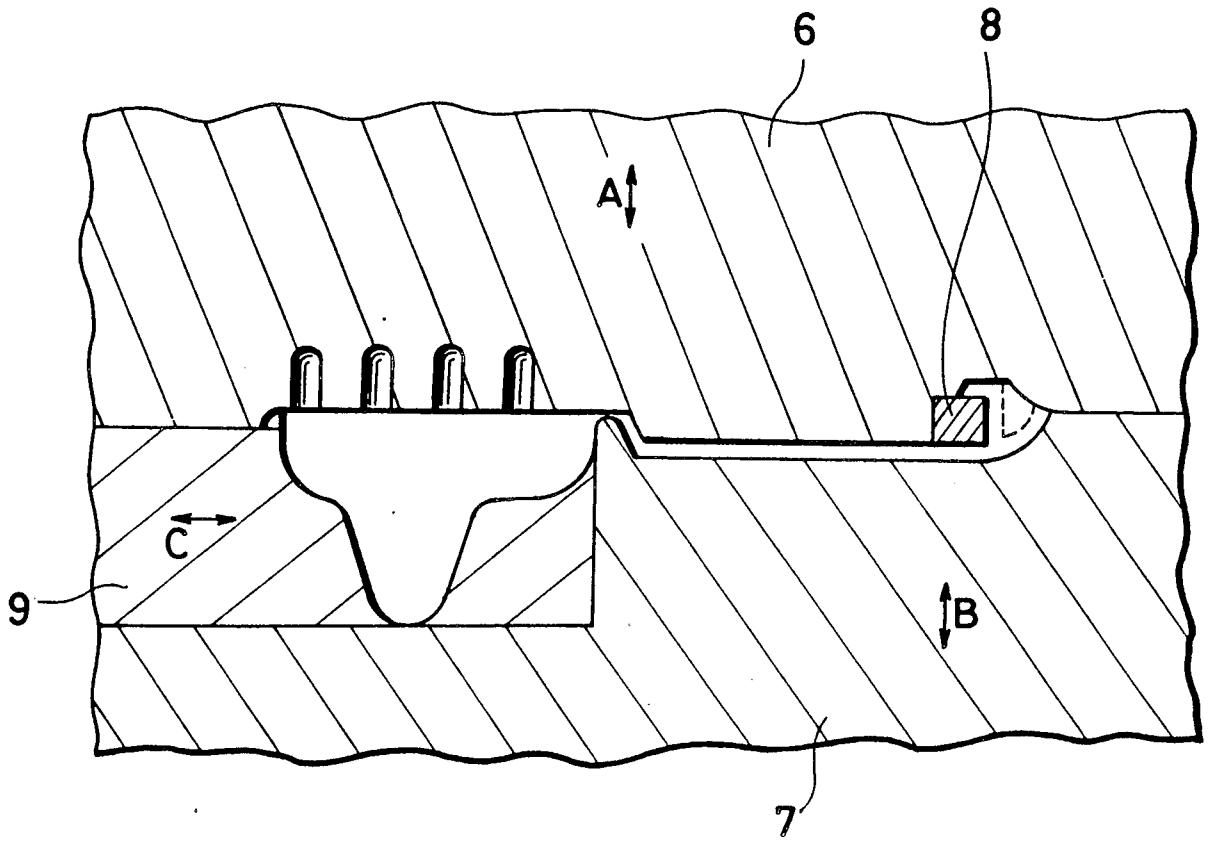
FIG. 7 is a sectional view showing a mold suitable for molding the yarn guide illustrated in FIG. 1.

FIG. 7 shows an example of mold usable for forming the yarn guide according to the invention. The illustrated mold includes an upper mold body 6 movable in the direction of an arrow A, and a lower mold body 7 movable in the direction of an arrow B. The mold further comprises a bar-like insert 8 necessary for forming the engaging pawl 3*a* of the hinge arm 3 (see FIG. 1), and an auxiliary mold body 9 movable in the direction of an arrow C for forming a main portion of the mounting ring 1. The mold itself does not constitute the feature of the invention, so that the details of the mold and its use for molding will not be described here.

The yarn guide described above may be modified in many ways. For instance, the mounting ring 1 and the hinge arm 3 may take many other forms than illustrated. The guide pins 2 may be provided in any number, and replaced by any other guide projections. Further, either one of the engaging projection 1*d* and the engaging pawl 3*a* may be replaced by an engaging recess or groove.

The present invention being thus described, it is obvious that the same may be varied in many other ways. Such variations are not to be regarded as departure from the spirit and scope of the invention, and all such modifications as would be obvious to those skilled in the art are intended to be included within the scope of the following claims.

I claim:

1. A knitting yarn guide comprising:

a resinous mounting ring having a finger insertion opening and providing a support surface, said support surface having a first end and a second end spaced from said first end, said ring being formed with a first engaging portion at said first end;

yarn guide projections formed integrally on said support surface between said first and second ends, said projections being spaced from each other; and a hinge arm having a base end portion which is connected to said mounting ring at said second end by a hinge integral with said arm and said ring, said arm being pivotable about said hinge between an open position away from said support surface and a yarn guiding position opposed to said support surface with a yarn guiding spacing, said base end portion of said arm assuming a rising posture relative to said support surface when said arm is pivoted to said yarn guiding position, said arm having a free end formed with a second engaging portion which is removably engageable with said first engaging portion when said arm assumes said yarn guiding position to define separate yarn guide passages between said yarn guide projections in cooperation with said support surface, wherein said arm and said support surface are spaced apart from each other, except at said base end and said free end, when said arm is pivoted to said yarn guiding position.

2. The yarn guide as defined in claim 1, wherein said yarn guide projections are in the form of pins.

3. The yarn guide as defined in claim 1, wherein said support surface is flat and elongated axially of said ring to extend from said first end to said second end.

4. The yarn guide as defined in claim 3, wherein said support surface is generally rectangular in plan view.

5. The yarn guide as defined in claim 3, wherein said hinge arm is generally rectangular in plan view.

6. The yarn guide as defined in claim 1, wherein said hinge arm is formed with an elongated opening through which said yarn guide projections penetrate when said arm assumes said yarn guiding position.

7. The yarn guide as defined in claim 1, wherein said hinge is provided by a thin-walled portion.

8. The yarn guide as defined in claim 1, wherein said first engaging portion is in the form of an engaging projection, and said second engaging portion is in the form of an engaging pawl.

9. The yarn guide as defined in claim 1, wherein said mounting ring has a split at a position diametrically opposite said support surface to make said finger insertion opening diametrically variable.

* * * * *